US009725672B2

(12) United States Patent
Fujita et al.

(10) Patent No.: US 9,725,672 B2
(45) Date of Patent: Aug. 8, 2017

(54) METHOD FOR LUBRICATING A CONTINUOUSLY VARIABLE TRANSMISSION, AND A CONTINUOUSLY VARIABLE TRANSMISSION

(75) Inventors: Hiroshi Fujita, Ichihara (JP); Toshihiko Ichihashi, Ichihara (JP); Kenji Kojima, Fuji (JP); Yoshie Arakawa, Fuji (JP); Makoto Maeda, Fuji (JP); Hideki Usuki, Fuji (JP)

(73) Assignees: IDEMITSU KOSAN CO., LTD, Tokyo (JP); JATCO Ltd., Fuji-shi (JP); NISSAN MOTOR CO., LTD, Yokohama-shi (JP)

( * ) Notice: Subject to any disclaimer, the term of this patent is extended or adjusted under 35 U.S.C. 154(b) by 171 days.

(21) Appl. No.: 13/579,636

(22) PCT Filed: Nov. 24, 2010

(86) PCT No.: PCT/JP2010/070914

§ 371 (c)(1),
(2), (4) Date: Aug. 17, 2012

(87) PCT Pub. No.: WO2011/102037

PCT Pub. Date: Aug. 25, 2011

(65) Prior Publication Data

US 2012/0316092 A1 Dec. 13, 2012

(30) Foreign Application Priority Data

Feb. 17, 2010 (JP) ..... 2010-032866

(51) Int. Cl.

*C10M 111/04* (2006.01)
*C10M 161/00* (2006.01)
*C10M 169/04* (2006.01)

(52) U.S. Cl.

CPC ..... *C10M 169/041* (2013.01); *C10M 111/04* (2013.01); *C10M 2203/1006* (2013.01); *C10M 2205/028* (2013.01); *C10M 2205/0285* (2013.01); *C10M 2205/12* (2013.01); *C10M 2207/026* (2013.01); *C10M 2207/027* (2013.01); *C10M 2207/028* (2013.01); *C10M 2207/125* (2013.01); *C10M 2207/141* (2013.01); *C10M 2207/146* (2013.01); *C10M 2207/262* (2013.01); *C10M 2207/282* (2013.01); *C10M 2207/289* (2013.01); *C10M 2209/084* (2013.01); *C10M 2209/104* (2013.01); *C10M 2215/04* (2013.01); *C10M 2215/064* (2013.01); *C10M 2215/08* (2013.01); *C10M 2215/224* (2013.01); *C10M 2215/28* (2013.01); *C10M 2219/044* (2013.01); *C10M 2219/046* (2013.01); *C10M 2219/106* (2013.01); *C10M 2223/045* (2013.01); *C10M 2229/02* (2013.01); *C10N 2220/021* (2013.01); *C10N 2220/022* (2013.01); *C10N 2230/02* (2013.01); *C10N 2230/06* (2013.01); *C10N 2240/045* (2013.01)

(58) Field of Classification Search

CPC ..... C10M 111/04; C10M 169/041; C10M 2203/1006; C10M 2205/028; C10M 2205/0285; C10M 2209/084

USPC ..... 508/162, 469

See application file for complete search history.

(56) References Cited

U.S. PATENT DOCUMENTS

| | | | | |
|---|---|---|---|---|
| 5,089,156 | A | 2/1992 | Chrisope et al. | |
| 5,360,562 | A | 11/1994 | Chrisope et al. | |
| 5,498,809 | A * | 3/1996 | Emert et al. | 585/13 |
| 5,858,935 | A | 1/1999 | Watts et al. | |
| 5,885,942 | A * | 3/1999 | Zhang et al. | 508/184 |
| 2001/0044389 | A1 | 11/2001 | Komiya et al. | |
| 2006/0135378 | A1 | 6/2006 | Takahashi et al. | |
| 2007/0191239 | A1 | 8/2007 | Matsuoka et al. | |
| 2007/0298990 | A1 * | 12/2007 | Carey et al. | 508/591 |

(Continued)

FOREIGN PATENT DOCUMENTS

| | | | |
|---|---|---|---|
| CN | 1759166 | A | 4/2006 |
| CN | 101617033 | A | 12/2009 |

(Continued)

OTHER PUBLICATIONS

Extended European Search Report issued Nov. 12, 2013 in Patent Application No. 10846168.2.

International Search Report Issued Dec. 28, 2010 in PCT/JP10/70914 Filed Nov. 24, 2010.

Office Action issued on May 14, 2013 in the corresponding Chinese Patent Application No. 201080064070.3 (with English Translation).

*Primary Examiner* — James Goloboy

(74) *Attorney, Agent, or Firm* — Oblon, McClelland, Maier & Neustadt, L.L.P.

(57) ABSTRACT

A lubricating oil composition for a continuously variable transmission contains at a specific content: (A) a mineral oil or PAO having a sulfur content of 0.03 mass % or less and a kinematic viscosity at 100 degrees C. from 1.5 $mm^2/s$ to 3 $mm^2/s$; (B) a mineral oil or PAO having a sulfur content of 0.03 mass % or less and a kinematic viscosity at 100 degrees C. from 5.5 $mm^2/s$ to 8 $mm^2/s$; (C) PAO having a kinematic viscosity at 100 degrees C. from 30 $mm^2/s$ to 400 $mm^2/s$; and (D) a polymethacrylate having a mass average molecular weight of 10000 to 40000, in which the total content of the components (C) and (D) is 19 mass % or more and the lubricating oil composition has a kinematic viscosity at 100 degrees C. from 5.5 $mm^2/s$ to 6.5 $mm^2/s$ and a kinematic viscosity at −20 degrees C. of 680 $mm^2/s$ or less.

2 Claims, No Drawings

(56) References Cited

U.S. PATENT DOCUMENTS

| | | | |
|---|---|---|---|
| 2010/0048440 | A1 | 2/2010 | Fujita et al. |
| 2012/0065109 | A1 | 3/2012 | Matsuoka et al. |
| 2012/0309659 | A1 | 12/2012 | Fujita |

FOREIGN PATENT DOCUMENTS

| | | | |
|---|---|---|---|
| EP | 1 808 476 | A1 | 7/2007 |
| EP | 2 119 761 | A1 | 11/2009 |
| EP | 2 535 398 | A1 | 12/2012 |
| GB | 2 360 528 | A | 9/2001 |
| JP | 4 264198 | | 9/1992 |
| JP | 2000 501126 | | 2/2000 |
| JP | 2001 262176 | | 9/2001 |
| JP | 2006 117852 | | 5/2006 |
| JP | 2008 208220 | | 9/2008 |
| JP | 2008 208221 | | 9/2008 |
| JP | 2009 292997 | | 12/2009 |
| WO | WO 97/16511 | A1 | 5/1997 |
| WO | 2004 074414 | | 2/2004 |
| WO | 2004 069967 | | 8/2004 |
| WO | 2008 105128 | | 9/2008 |

* cited by examiner

METHOD FOR LUBRICATING A CONTINUOUSLY VARIABLE TRANSMISSION, AND A CONTINUOUSLY VARIABLE TRANSMISSION

CROSS-REFERENCE TO RELATED APPLICATIONS

This application is a National Stage of PCT/JP2010/070914, which was filed on Nov. 24, 2010. This application is based upon and claims the benefit of priority to Japanese Application No. 2010-032866, which was filed on Feb. 17, 2010.

TECHNICAL FIELD

The present invention relates to a lubricating oil composition for a continuously variable transmission. More specifically, the present invention relates to a lubricating oil composition for a continuously variable transmission with a low viscosity, a high viscosity index, a favorable shear stability and a long fatigue life.

BACKGROUND ART

In recent years, due to a global issue of carbon dioxide emission and worldwide increase of energy demand, saving automobile fuel has been demanded more and more. Under such circumstances, it has been demanded that a transmission (i.e., a component of an automobile) also contributes to fuel-saving more than ever.

For instance, one of fuel-saving methods of the transmission is lowering a viscosity of a lubricating oil. Among the transmission, a continuously variable transmission for an automobile is provided with a torque convertor, a wet clutch, a gear bearing mechanism, an oil pump, a hydraulic pressure controlling mechanism and the like. Lowering the viscosity of the lubricating oil used for such components reduces stirring resistance and friction resistance, thereby improving fuel efficiency of the automobile. However, the low-viscosity lubricating oil occasionally generates seizure due to a reduced shear stability and decreases the fatigue life.

In view of the above, Patent Literature 1 reports a lubricating oil composition capable of maintaining a gear shifting performance and the like for a long period of time, in which various additives are contained for optimization. However, since the invention disclosed in Patent Literature 1 is not directed to fuel-saving, a kinematic viscosity of the lubricating oil composition is high and a fatigue life thereof when the viscosity is lowered has not been studied.

Moreover, in order to further promote fuel-saving, decreasing the viscosity at low temperatures while maintaining the viscosity at high temperatures, in short, viscosity-index improvement has been demanded from the viewpoint of low-temperature startability.

For instance, a viscosity index of a lubricating oil composition disclosed in Patent Literature 2 is improved with a polymethacrylate (PMA) as a viscosity index improver. Moreover, in lubricating oil compositions disclosed in Patent Literatures 3 and 4, a viscosity property is improved with a high-viscosity synthetic oil (poly-alpha-olefin: PAO) and an olefin copolymer (OCP) effective for improving the fatigue life is further contained.

CITATION LIST

Patent Literature(s)

Patent Literature 1: JP-A-2001-262176
Patent Literature 2: JP-A-2006-117852

Patent Literature 3: JP-A-2008-208220
Patent Literature 4: JP-A-2008-208221

SUMMARY OF THE INVENTION

Problems to be Solved by the Invention

However, since fatigue-life improvement and viscosity-index improvement are in inverse proportion to each other, the lubricating oil composition of Patent Literature 2 has a poor oil-film retention whereas having an improved viscosity index. In Patent Literatures 3 and 4, although OCP is blended in the lubricating oil composition, the lubricating oil composition does not exhibit the viscosity index that is equal to or exceeds the viscosity index of PAO. Thus, the viscosity-index improvement has not been studied. In other words, technique to improve the viscosity index while having a sufficient fatigue life has been neither realized nor studied.

Accordingly, an object of the invention is to provide a lubricating oil composition for a continuously variable transmission with a low viscosity, a high viscosity index, a favorable shear stability and a long fatigue life.

Means for Solving the Problems

As result of dedicated studies for solving the problem, the inventors have found that the following combination of a specific base oil and a specific additive to provide a specific viscosity property of the finished oil can solve the problem, and has achieved the invention.

Specifically, the invention provides the following lubricating oil composition.

(1) A lubricating oil composition for a continuously variable transmission according to an aspect of the invention contains: (A) at least one of a mineral oil and a poly-alpha-olefin in a range of 45 mass % to 65 mass % based on a total amount of the composition, the mineral oil and the poly-alpha-olefin comprising a sulfur content of 0.03 mass % or less and having a kinematic viscosity at 100 degrees C. in a range of 1.5 $mm^2/s$ to 3 $mm^2/s$; (B) at least one of a mineral oil and a poly-alpha-olefin in a range of 10 mass % to 20 mass % based on the total amount of the composition, the mineral oil and the poly-alpha-olefin comprising a sulfur content of 0.03 mass % or less and having a kinematic viscosity at 100 degrees C. in a range of 5.5 $mm^2/s$ to 8 $mm^2/s$; (C) a poly-alpha-olefin having a kinematic viscosity at 100 degrees C. in a range of 30 $mm^2/s$ to 400 $mm^2/s$ at a content in a range of 5 mass % to 12 mass % based on the total amount of the composition; and (D) a polymethacrylate having a mass average molecular weight in a range of 10000 to 40000 at a content in a range of 8 mass % to 14 mass % based on the total amount of the composition, in which the total content of the components (C) and (D) is 19 mass % or more, and the lubricating oil composition has a kinematic viscosity at 100 degrees C. in a range of 5.5 $mm^2/s$ to 6.5 $mm^2/s$ and a kinematic viscosity at −20 degrees C. of 680 $mm^2/s$ or less.

(2) In the lubricating oil composition for the continuously variable transmission according to the above aspect of the invention, the kinematic viscosity at 100 degrees C. of the component (A) is in a range of 1.5 $mm^2/s$ to 2.5 $mm^2/s$, the kinematic viscosity at 100 degrees C. of the component (B) is in a range of 5.5 $mm^2/s$ to 7.5 $mm^2/s$, the mass average molecular weight of the component (D) is in a range of 10000 to 30000, and the kinematic viscosity at 100 degrees C. of the lubricating oil composition is in a range of 5.8 $mm^2/s$ to 6.5 $mm^2/s$.

(3) In the lubricating oil composition for the continuously variable transmission according to the above aspect of the invention, the kinematic viscosity at 100 degrees C. of the component (B) is in a range of 5.5 $mm^2/s$ to 7.0 $mm^2/s$, the mass average molecular weight of the component (D) is in a range of 15000 to 30000, and the kinematic viscosity at −20 degrees C. of the lubricating oil composition is 660 $mm^2/s$ or less.

(4) In the lubricating oil composition for the continuously variable transmission according to the above aspect of the invention, the lubricating oil composition is used for a belt-type continuously variable transmission.

According to the invention, a lubricating oil composition for a continuously variable transmission with a low viscosity, a high viscosity index, a favorable shear stability and a long fatigue life can be provided. Particularly, the lubricating oil composition for the continuously variable transmission according to the invention is preferably applicable as a lubricating oil for a belt-type continuously variable transmission.

DESCRIPTION OF EMBODIMENT(S)

A lubricating oil composition of the invention contains the aforementioned components (A) to (D). The invention will be described below in detail.

Component (A)

The lubricating oil composition for the continuously variable transmission according to the invention contains at least one of a mineral oil and a poly-alpha-olefin (hereinafter, also referred to as PAO) in a range of 45 mass % to 65 mass % as the component (A), in which the mineral oil and PAO contain a sulfur content of 0.03 mass % or less and have a kinematic viscosity at 100 degrees C. in a range of 1.5 $mm^2/s$ to 3 $mm^2/s$, preferably of 1.5 $mm^2/s$ to 2.5 $mm^2/s$.

When the kinematic viscosity at 100 degrees C. is less than 1.5 $mm^2/s$, vaporizability is increased. When the kinematic viscosity at 100 degrees C. exceeds 3 $mm^2/s$, the viscosity index is decreased.

When the sulfur content in the component (A) exceeds 0.03 mass %, oxidation stability is deteriorated.

When the content of the component (A) is less than 45 mass %, a viscosity of the finished lubricating oil composition is increased, which may unfavorably increase friction loss when the finished lubricating oil composition is used for the continuously variable transmission. When the content of the component (A) exceeds 65 mass %, the viscosity is decreased, which may unfavorably increase abrasion of mechanical components when the finished lubricating oil composition is used for the continuously variable transmission.

Preferably, examples of the mineral oil used for the component (A) include paraffinic and naphthenic mineral oils which can be obtained by subjecting a lubricating oil fraction produced by atmospheric- and vacuum-distillation of a crude oil, to any suitable combination of refining processes selected from solvent-deasphalting, solvent-extracting, hydrocracking, solvent-dewaxing, catalytic-dewaxing, hydrorefining, sulfuric acid treatment and clay treatment.

Examples of PAO include 1-octene oligomer and 1-decene oligomer.

Among these mineral oils and PAO, the mineral oil and PAO having the kinematic viscosity at 100 degrees C. in the above range may be used alone or in a mixture of two or more selected from the mineral oils and PAO at any rate.

Component (B)

The lubricating oil composition for the continuously variable transmission according to the invention contains at least one of a mineral oil and a poly-alpha-olefin in a range of 10 mass % to 20 mass % as the component (B), in which the mineral oil and PAO contain a sulfur content of 0.03 mass % or less and have a kinematic viscosity at 100 degrees C. in a range of 5.5 $mm^2/s$ to 8 $mm^2/s$, preferably of 5.5 $mm^2/s$ to 7.5 $mm^2/s$.

When the kinematic viscosity at 100 degrees C. is less than 5.5 $mm^2/s$, a viscosity index is unfavorably decreased. When the kinematic viscosity at 100 degrees C. exceeds 8 $mm^2/s$, the viscosity at low temperatures is unfavorably increased.

When the sulfur content in the component (B) exceeds 0.03 mass %, oxidation stability is deteriorated.

When the content of the component (B) is less than 10 mass %, a viscosity of the finished lubricating oil composition is decreased, which may unfavorably increase abrasion of mechanical components when the finished lubricating oil composition is used for the continuously variable transmission. When the content of the component (B) exceeds 20 mass %, the viscosity of the finished lubricating oil composition is increased, which may unfavorably increase friction loss.

The mineral oil or the poly-alpha-olefin contained in the component (B) is the same as that contained in the component (A).

Component (C)

The lubricating oil composition according to the invention contains a poly-alpha-olefin in a range of 5 mass % to 12 mass % as the component (C), in which the poly-alpha-olefin has a kinematic viscosity at 100 degrees C. in a range of 30 $mm^2/s$ to 400 $mm^2/s$.

When the kinematic viscosity at 100 degrees C. is less than 30 $mm^2/s$, a viscosity index is unfavorably decreased. When the kinematic viscosity at 100 degrees C. exceeds 400 $mm^2/s$, shear stability is unfavorably decreased.

When the content of the component (C) is less than 5 mass %, the viscosity of the finished lubricating oil composition is decreased, which may unfavorably increase abrasion of mechanical components when the finished lubricating oil composition is used for the continuously variable transmission. When the content of the component (C) exceeds 12 mass %, the viscosity is increased, which may unfavorably increase friction loss.

Component (D)

The lubricating oil composition according to the invention contains a polymethacrylate (hereinafter, referred to as PMA) in a range of 8 mass % to 14 mass % as the component (D), in which PMA has a mass average molecular weight of 10000 to 40000, preferably of 10000 to 30000, more preferably of 15000 to 30000.

When the mass average molecular weight is less than 10000, the viscosity index is unfavorably decreased. When the mass average molecular weight exceeds 40000, shear stability may be unfavorably decreased.

When the content of the component (D) is less than 8 mass %, the viscosity of the lubricating oil composition is decreased, which may unfavorably increase abrasion of mechanical components when the lubricating oil composition is used for the continuously variable transmission. When the content of the component (D) exceeds 12 mass %, the viscosity of the lubricating oil composition is increased, which may unfavorably increase friction loss when the lubricating oil composition is used for the continuously variable transmission.

The total content of the components (C) and (D) is preferably 19 mass % or more based on the total amount of the composition, more preferably from 19 mass % to 40 mass %. When the content of each of the components is satisfied, the lubricating oil composition according to the invention exhibits a viscosity suitable for a continuously variable transmission.

Other Additives

The lubricating oil composition according to the invention may be added as necessary with other additives such as a detergent, an ashless dispersant, an antiwear agent, a friction modifier, a rust inhibitor, a metal deactivator, an antifoaming agent, an antioxidant and a coloring agent, as long as advantages of the invention are not hampered.

The detergent is exemplified by a metal detergent such as a neutral metal sulfonate, a neutral metal phenate, a neutral metal salicylate, a neutral metal phosphonate, a basic sulfonate, a basic phenate, a basic salicylate, an overbased sulfonate, an overbased salicylate and an overbased phosphonate. The content of the detergent is preferably approximately in a range of 0.01 mass % to 10 mass % based on the total amount of the composition.

Examples of the ashless dispersant include: succinimides; boron-containing succinimides; benzil amines; boron-containing benzil amines; succinates; and monovalent or divalent carboxylic amides represented by fatty acid or succinic acid. The content of the ashless dispersant is preferably approximately in a range of 0.1 mass % to 20 mass % based on the total amount of the composition.

Examples of the antiwear agent include: a sulfur antiwear agent such as a salt of thiophosphoric acid and a metal (e.g., Zn, Pb, Sb) and a salt of thiocarbamic acid and a metal (e.g., Zn); and a phosphorus antiwear agent such as a phosphate ester (tri cresyl phosphate). The content of the antiwear agent is preferably approximately in a range of 0.05 mass % to 5 mass % based on the total amount of the composition.

The friction modifier is exemplified by a partial ester of polyhydric alcohol such as neopentyl glycol monolaurate, trimethylolpropane monolaurate, and glycerin monooleate (monoglyceride oleate) The content of the friction modifier is preferably approximately in a range of 0.05 mass % to 4 mass % based on the total amount of the composition.

Examples of the rust inhibitor are a fatty acid, an alkenyl succinic acid half ester, a fatty acid soap, an alkyl sulfonate, a fatty acid ester of polyhydric alcohol, a fatty acid amide, an oxidized paraffin, and an alkyl polyoxyethylene ether. The content of the rust inhibitor is preferably approximately in a range of 0.01 mass % to 3 mass % based on the total amount of the composition.

Examples of the metal deactivator include benzotriazole, a benzotriazole derivative, triazole, a triazole derivative, imidazole, an imidazole derivative and thiadiazole, which are used alone or in combination of two or more thereof. The content of the metal deactivator is preferably approximately in a range of 0.01 mass % to 5 mass % based on the total amount of the composition.

Examples of the antifoaming agent include a silicone compound and an ester compound, which may be used alone or in a combination of two or more. The content of the antifoaming agent is preferably approximately in a range of 0.05 mass % to 5 mass % based on the total amount of the composition.

Preferable examples of the antioxidant include: a hindered phenolic antioxidant, an amine antioxidant, and zinc alkyldithiophosphate (ZnDTP). A bisphenol antioxidant and an ester group-containing phenol antioxidant are particularly preferable as the phenolic antioxidant. A dialkyldiphenylamine antioxidant and a naphthylamine antioxidant are preferable as the amine antioxidant. The content of the antioxidant is preferably approximately in a range of 0.05 mass % to 7 mass %.

The lubricating oil composition for the continuously variable transmission containing the above components according to the invention has a kinematic viscosity at 100 degrees C. in a range of 5.5 $mm^2/s$ to 6.5 $mm^2/s$, preferably of 5.8 $mm^2/s$ to 6.5 $mm^2/s$ and a kinematic viscosity at −20 degrees C. of 680 $mm^2/s$ or less, preferably 660 $mm^2/s$ or less.

When the lubricating oil composition having the kinematic viscosity at 100 degrees C. less than 5.5 $mm^2/s$ is used for the continuously variable transmission, abrasion of mechanical components is increased to decrease reliability and durability of the machine. When the kinematic viscosity at 100 degrees C. exceeds 6.5 $mm^2/s$, friction loss is increased, which hampers fuel-saving performance when the lubricating oil composition is used for the continuously variable transmission. When the kinematic viscosity at −20 degrees C. exceeds 680 $mm^2/s$, friction loss in an area between low temperatures and normal temperatures is increased, which hampers the target fuel-saving performance when the lubricating oil composition is used for the continuously variable transmission.

When the lubricating oil composition for the continuously variable transmission according to the invention is provided with the components, the content of each of the components and the viscosity as described above, the lubricating oil composition can exhibit a low viscosity, a high viscosity index and a favorable shear stability and can keep a long fatigue life of the mechanical components when the lubricating oil composition is used for the continuously variable transmission.

EXAMPLES

Next, examples of the invention will be described below in detail. However, it should be noted that the scope of the invention is by no means limited by the examples.

Examples 1 to 5 and Comparatives 1 to 5

Lubricating oil compositions were prepared according to the blend composition set forth in Table 1. The prepared compositions were measured according to the following method in terms of the kinematic viscosity at 100 degrees C., the kinematic viscosity at −20 degrees C., a BF viscosity at −40 degrees C., a viscosity after shearing and a rolling four-ball fatigue life.

The components described in Table 1 are as follows.

Mineral oil-1: Mineral oil containing a sulfur content of 0.03 mass % or less and having a kinematic viscosity at 100 degrees C. of 2.2 $mm^2/s$ and a kinematic viscosity at 40 degrees C. of 7.1 $mm^2/s$ Mineral oil-2: Mineral oil containing a sulfur content of 0.03 mass % or less and having a kinematic viscosity at 100 degrees C. of 6.5 $mm^2/s$ and a kinematic viscosity at 40 degrees C. of 37 $mm^2/s$ PAO-1: PAO having a kinematic viscosity at 100 degrees C. of 1.8 $mm^2/s$ PAO-2: PAO having a kinematic viscosity at 100 degrees C. of 3.9 $mm^2/s$ PAO-3: PAO having a kinematic viscosity at 100 degrees C. of 9.8 $mm^2/s$ PAO-4: PAO having a kinematic viscosity at 100 degrees C. of 100 $mm^2/s$ PMA-1: Polymethacrylate having a mass average molecular weight of 20000

PMA-2: Polymethacrylate having a mass average molecular weight of 50000

Additives for the CVT oil: Package including Detergent (e.g., Ca sulfonates), Dispersant (e.g., succinimides), Extreme pressure additive and Antiwear agent (e.g., sulfides, phosphate compounds, sulfurated phosphate compounds), Antifoaming agent, Copper deactivator, etc.

Kinematic Viscosity at 140 degrees C., 100 degrees C. and −20 degrees C.

Measurement was conducted according to JIS K2283.

Viscosity Index

Measurement was conducted according to JIS K2283.

BF Viscosity

Measurement was conducted based on JPI-5S-26-85.

Kinematic Viscosity Before and After Shearing

Kinematic viscosities at 140 degrees C. before and after the 30-hour test (shear stability test) conducted according to JASO M-347 were measured.

Rolling Four-Ball Fatigue Life

Time until generation of pitting was measured according to a rolling four-ball test. Measurement was conducted under conditions of a load of 6.9 GPa, a rotation speed of 2200 rpm and an oil temperature of 90 degrees C. with ¾-inch balls made of SUJ-2.

words, since the lubricating oil composition according to the invention has a low viscosity, a high viscosity index and a high low-temperature fluidity, when used for the continuously variable transmission, the lubricating oil composition according to the invention provides less friction loss and better low-temperature startability than those of the commercially available product. In short, it is shown that the lubricating oil composition according to the invention can accomplish fuel-saving.

Moreover, the values of the kinematic viscosity after shearing and the rolling four-ball fatigue life test are kept equal to those of the commercially available product. Accordingly, the lubricating oil composition according to the invention has a low viscosity, a high viscosity index, a favorable shear stability and a long fatigue life.

On the other hand, as compared with the lubricating oil compositions in Examples, none of the lubricating oil compositions in Comparatives 1 to 4 and the commercially available product exhibits a low viscosity, a high viscosity index, a favorable low-temperature fluidity, a favorable shear stability and a favorable fatigue life. In Comparative 1, the kinematic viscosity at −20 degrees C. is high and the fatigue life is short. In Comparative 2, the kinematic viscosity after shearing is low and the fatigue life is short. In Comparative 3, the value of the BF viscosity is high and the low-temperature fluidity is poor. In Comparative 4, since the

TABLE 1

| Components | | | Examples | | | | | Comparatives | | | | |
|---|---|---|---|---|---|---|---|---|---|---|---|---|
| | | | 1 | 2 | 3 | 4 | 5 | 1 | 2 | 3 | 4 | 5 |
| (A) | PAO-1 | mass % | — | — | 10.0 | 51.0 | — | — | — | — | — | Commercially available product |
| | Mineral oil-1 | mass % | 56.0 | 55.5 | 44.5 | — | 51.0 | 49.0 | 58.5 | 67.0 | 58.0 | |
| (B) | Mineral oil-2 | mass % | 15.0 | 15.0 | 17.0 | 19.0 | — | 15.0 | 15.0 | — | 15.0 | |
| | PAO-2 | mass % | — | — | — | — | 20.0 | — | — | — | — | |
| (C) | PAO-3 | mass % | — | — | — | — | — | 15.0 | — | — | — | |
| | PAO-4 | mass % | 9.0 | 12.0 | 6.0 | 8.0 | 9.0 | — | 9.0 | 13.0 | 7.0 | |
| (D) | PMA-1 | mass % | 11.5 | 9.0 | 14.0 | 13.5 | 11.5 | 12.5 | — | 11.5 | 11.5 | |
| | PMA-2 | mass % | — | — | — | — | — | — | 9.0 | — | — | |
| Others | Additives for CVT oil | mass % | 8.5 | 8.5 | 8.5 | 8.5 | 8.5 | 8.5 | 8.5 | 8.5 | 8.5 | |
| Total | | mass % | 100.0 | 100.0 | 100.0 | 100.0 | 100.0 | 100.0 | 100.0 | 100.0 | 100.0 | |
| Properties | Viscosity index | — | 215 | 210 | 213 | 216 | 209 | 199 | 207 | 224 | 202 | 203 |
| | Kinematic viscosity | (100° C.)($mm^2/s$) | 6.31 | 6.31 | 6.29 | 6.32 | 6.33 | 6.32 | 6.30 | 6.31 | 5.80 | 7.10 |
| | Kinematic viscosity | (−20° C.)($mm^2/s$) | 600 | 640 | 570 | 570 | 620 | 760 | 590 | 580 | 560 | 890 |
| | BF viscosity | (−40° C.) (mPa · s) | 5000 | 5500 | 4400 | 4500 | 4900 | 7500 | 5000 | 10000 | 4800 | 8500 |
| | Kinematic viscosity before shearing (140° C.)($mm^2/s$) | | 3.53 | 3.51 | 3.52 | 3.54 | 3.52 | 3.48 | 3.53 | 3.59 | 3.24 | 3.86 |
| | Kinematic viscosity after shearing (140° C.)($mm^2/s$) | | 3.18 | 3.18 | 3.17 | 3.20 | 3.18 | 3.17 | 2.99 | 3.19 | 2.94 | 3.18 |
| | Rolling four-ball fatigue life (min) | | 175 | 173 | 179 | 178 | 174 | 142 | 151 | 166 | 144 | 173 |

Evaluation Results

As shown in Table 1, in Examples 1 to 5 using the lubricating oil composition according to the invention, the kinematic viscosities at 100 degrees C. and −20 degrees C. are kept lower than those of a commercially available product (Comparative 5). In other words, it can be said that the lubricating oil composition according to the invention exhibits a low viscosity and a low temperature-dependence of the viscosity, so that the viscosity index is improved. The BF viscosity at −40 degrees C. in each Example is kept lower than that of the commercially available product, which shows that low-temperature fluidity is better. In other kinematic viscosity at 100 degrees C. is low, the kinematic viscosity after shearing is also low and is not maintainable at a suitable value while the fatigue life is short.

The invention claimed is:

1. A method for lubricating a continuously variable transmission comprising contacting a lubricating oil composition with a continuously variable transmission;

wherein said lubricating oil composition comprises components (A), (B), (C) and (D); wherein:

the component (A) contains 45 to 65 mass % of a mineral oil, a poly-alpha-olefin, or a mixture of a mineral oil and a poly-alpha-olefin, wherein the sulfur content of each of said mineral oil and poly-alpha-olefin does not exceed 0.03% by mass and wherein each of the mineral oil and poly-alpha-olefin has a kinematic viscosity at 100 degrees C. in a range of 1.5 $mm^2/s$ to 3 $mm^2/s$;

the component (B) contains 10 to 20 mass % of a mineral oil or a mixture of a mineral oil and a poly-alpha-olefin, wherein the sulfur content of each of said mineral oil and poly-alpha-olefin does not exceed 0.03% by mass, and wherein each of said mineral oil and poly-alpha-olefin has a kinematic viscosity at 100 degrees C. ranging from 5.5 $mm^2/s$ to 8 $mm^2/s$;

the component (C) contains from 5 to 12 mass % of a poly-alpha-olefin having a kinematic viscosity at 100 degrees C. in a range of 30 $mm^2/s$ to 400 $mm^2/s$; and the component (D) contains from 8 to 14 mass % of a polymethacrylate having a mass average molecular weight in a range of 10,000 to 40,000;

wherein a total content of the components (C) and (D) in said composition is 19 mass % or more;

wherein the mass % of the components (A), (B), (C) and (D) are based on the total mass of said lubricating oil composition; and wherein the lubricating oil composition has a kinematic viscosity at 100 degrees C. in a range of 5.5 $mm^2/s$ to 6.5 $mm^2/s$ and a kinematic viscosity at −20 degrees C. of 680 $mm^2/s$ or less.

2. A continuously variable transmission, comprising a lubricating oil composition that comprises components (A), (B), (C) and (D); wherein:

the component (A) contains 45 to 65 mass % of a mineral oil, a poly-alpha-olefin, or a mixture of a mineral oil and a poly-alpha-olefin, wherein the sulfur content of each of said mineral oil and poly-alpha-olefin does not exceed 0.03% by mass and wherein each of the mineral oil and poly-alpha-olefin has a kinematic viscosity at 100 degrees C. in a range of 1.5 $mm^2/s$ to 3 $mm^2/s$;

the component (B) contains 10 to 20 mass % of a mineral oil or a mixture of a mineral oil and a poly-alpha-olefin, wherein the sulfur content of each of said mineral oil and poly-alpha-olefin does not exceed 0.03% by mass, and wherein each of said mineral oil and poly-alpha-olefin has a kinematic viscosity at 100 degrees C. ranging from 5.5 $mm^2/s$ to 8 $mm^2/s$;

the component (C) contains from 5 to 12 mass % of a poly-alpha-olefin having a kinematic viscosity at 100 degrees C. in a range of 30 $mm^2/s$ to 400 $mm^2/s$; and the component (D) contains from 8 to 14 mass % of a polymethacrylate having a mass average molecular weight in a range of 10,000 to 40,000;

wherein a total content of the components (C) and (D) in said composition is 19 mass % or more;

wherein the mass % of the components (A), (B), (C) and (D) are based on the total mass of said lubricating oil composition; and wherein the lubricating oil composition has a kinematic viscosity at 100 degrees C. in a range of 5.5 $mm^2/s$ to 6.5 $mm^2/s$ and a kinematic viscosity at −20 degrees C. of 680 $mm^2/s$ or less.

* * * * *